US007629783B2

(12) United States Patent
Chang

(10) Patent No.: US 7,629,783 B2
(45) Date of Patent: Dec. 8, 2009

(54) ULTRA LOW DROPOUT VOLTAGE REGULATOR

(75) Inventor: Kee Seok Chang, Daejeon (KR)

(73) Assignee: Taejin Technology Co., Ltd., Daejeon (KR)

( * ) Notice: Subject to any disclaimer, the term of this patent is extended or adjusted under 35 U.S.C. 154(b) by 187 days.

(21) Appl. No.: 11/962,404

(22) Filed: Dec. 21, 2007

(65) Prior Publication Data

US 2009/0039849 A1 Feb. 12, 2009

(30) Foreign Application Priority Data

Aug. 6, 2007 (KR) ..... 10-2007-0078660

(51) Int. Cl.
*G05F 1/569* (2006.01)
*G05F 1/573* (2006.01)

(52) U.S. Cl. ..... 323/276; 323/275

(58) Field of Classification Search ..... 323/273, 323/274, 275, 276, 277, 279, 280, 908; 361/18, 361/87, 93.1, 93.9; 363/50
See application file for complete search history.

(56) References Cited

U.S. PATENT DOCUMENTS 4,800,331 A * 1/1989 Vesce et al. ..... 323/277
6,310,467 B1 * 10/2001 Sauer ..... 323/273
6,603,292 B1 * 8/2003 Schouten et al. ..... 323/277
7,215,103 B1 * 5/2007 Wong et al. ..... 323/277

* cited by examiner

*Primary Examiner*—Gary L Laxton
(74) *Attorney, Agent, or Firm*—Drinker Biddle & Reath LLP

(57) ABSTRACT

An ultra low dropout voltage regulator, which separately supplies operating power for internal circuits, but controls the operating power to perform the operation of a voltage regulator chip, so that an ultra low dropout voltage regulator can be designed to reduce standby power consumption and to minimize the size of the chip, can be designed to more rapidly respond to the overload or overvoltage of the chip and to stably and precisely shut down the chip in the event of the overload or overvoltage, and can be designed to realize ultra low dropout characteristics even at a low output voltage.

18 Claims, 7 Drawing Sheets

ULTRA LOW DROPOUT VOLTAGE REGULATOR

CROSS-REFERENCE TO RELATED PATENT APPLICATIONS

This application claims the benefit of Korean Patent Application No. 10-2007-0078660, filed on Aug. 6, 2007, in the Korean Intellectual Property Office, the disclosure of which is incorporated herein in its entirety by reference.

FIELD OF THE INVENTION

The present invention relates, in general, to voltage regulators, and, more particularly, to an ultra low dropout voltage regulator, which separately supplies operating power for internal circuits, but controls the operating power to perform the operation of a voltage regulator chip, so that an ultra low dropout voltage regulator can be designed to reduce standby power consumption and to minimize the size of the chip, can be designed to more rapidly respond to the overload or overvoltage of the chip and to stably and precisely shut down the chip in the event of the overload or overvoltage, and can be designed to realize ultra low dropout (hereinafter referred to as 'ULDO') characteristics even at a low output voltage.

BACKGROUND OF THE INVENTION

Recently, the operating voltage of various types of electronic appliances has gradually decreased. As an example, Microcontroller Units (MCUs) and main chip products, which operate at a voltage of 0.9 to 1.0V, have recently been developed.

As the operating voltage of electronic devices decreases in this way, the output voltage of a voltage regulator for driving the electronic devices must also gradually decrease. That is, as the power supply voltage that must be supplied to drive the MCUs and the main chips gradually decreases, a voltage regulator is increasingly required to output a stable and low output voltage.

FIG. 1 is a block diagram of a conventional low output voltage regulator, and FIG. 2 is a graph showing the ultra low dropout characteristics of a conventional low output voltage regulator.

As shown in FIG. 1, a conventional low output voltage regulator 1 includes a chip enable unit 10, a reference voltage generation unit (1.2V voltage reference) 20, an error amplification stage (error AMP) 30, an overload protection unit 40, a gate drive stage 50, a pass element 60, and a voltage division circuit (resistive feedback network) 70.

The chip enable unit 10 outputs an enable signal so as to directly supply power to respective functional blocks.

The reference voltage generation unit 20 receives an initial voltage signal, and divides the initial voltage signal into connected circuit units, thus setting voltage and current to a reference voltage within an output range. The reference voltage generation unit 20 generates the reference voltage to be compared to a divided voltage, the divided voltage being generated through the division of input voltage by the voltage division circuit 70, which is composed of a transistor and a trimming feedback resistor.

The error amplification stage 30 compares the reference voltage, output from the reference voltage generation unit 20, with the divided voltage, output from the voltage division circuit 70, and thus amplifies the difference between the voltages.

The overload protection unit 40 includes a thermal shutdown stage 41, which is provided with a plurality of transistors, diodes, and resistors, is adapted to compare the signal generated by the reference voltage generation unit 20 with output voltage, and is operated to decrease the output voltage when an overload occurs or when the temperature increases beyond a certain temperature while operation is not in a normal mode, a switching control stage 43, which stabilizes the signal output from the thermal shutdown stage 41 and transmits the output signal to an output interface, and an overcurrent protection stage 42.

The pass element 60, which passes only a stable voltage through a selected interface, is stabilized by the gate drive stage 50 and is adjusted to a certain level.

However, the conventional low output voltage regulator is problematic in that, since it is constructed to allow the chip enable unit 10 to supply power to respective functional blocks, power is shut off by only the logic-off operation of the chip in a disabled state, in which the driving of the chip is stopped, and thus standby power is continuously consumed.

Further, the conventional low output voltage regulator is problematic in that, when the reference voltage generation unit 20 outputs a low reference voltage, an internal feedback voltage is very low, so that a separate process for a low voltage MOS transistor (Metal Oxide Semiconductor Field Effect Transistor: MOSFET) must be added, or a deep sub-micron process below 0.18□ is required, in order to allow the transistor of the input stage of a differential amplifier to have a low threshold voltage (Vt).

Further, the conventional low output voltage regulator is problematic in that, since the voltage division circuit 70 has a resistor structure composed of trimming pads, the size of the regulator chip is increased, and thus the manufacturing costs thereof are increased.

Moreover, when the voltage regulator chip, which is a power Integrated Circuit (IC), is broken, or when the temperature thereof reaches a temperature at which the normal operation of the voltage regulator is difficult, the thermal shutdown stage 41 of the overload protection unit 40 of the conventional low output voltage regulator must accurately and stably stop the driving of the chip at high speed. Further, when the temperature decreases again, the thermal shutdown stage 41 must resume normal operation.

Meanwhile, as shown in FIG. 2, the conventional low output voltage regulator starts to exhibit ultra low dropout characteristics only when the input voltage becomes equal to or greater than a minimum input voltage $V_{IN,MIN}$ enabling the normal operation of the circuit, regardless of the ULDO. In other words, when an output voltage $V_{output}$ is greater than the difference between the minimum input voltage $V_{IN,MIN}$ and the ultra low dropout $V_{DROPOUT}$, normal ULDO can be obtained.

However, recently, when low output voltage is required to supply power supply voltage for MCUs and main chips, the voltages of which have gradually decreased, that is, when low input voltage less than the minimum input voltage $V_{IN,MIN}$ is desired to be converted into a low output voltage $V_{01}$ or $V_{O2}$, there is a problem in that voltage dropout greater than the ultra low dropout $V_{DROPOUT}$ occurs.

BRIEF SUMMARY OF THE INVENTION

Accordingly, the present invention has been made keeping in mind the above problems occurring in the prior art, and an object of the present invention is to provide an ultra low dropout voltage regulator, which performs control so as to separately supply the power required for circuits and the input voltage to be converted and transmitted, thus minimizing the consumption of standby power.

Another object of the present invention is to provide an ultra low dropout voltage regulator, in which a reference voltage generation unit having low output voltage can be implemented, without needing to implement the transistor of the input stage of a differential amplifier, used in a reference voltage generation unit, in the form of a MOS transistor operating at a low voltage, through a separate process, and without requiring a deep sub-micron process, thus decreasing manufacturing costs.

A further object of the present invention is to provide an ultra low dropout voltage regulator, in which a voltage division unit, having a resistor structure implemented using trimming pads, can be implemented without using trimming pads, thus enabling a voltage regulator chip to have an ultra small size, and reducing the manufacturing costs thereof.

Yet another object of the present invention is to provide an ultra low dropout voltage regulator, in which an overheat sensing circuit can be implemented to sense the overheat temperature of a regulator chip and to more rapidly respond to overheating, and in which an overheat protection circuit is simply constructed to reduce costs while guaranteeing the reliability and stability of a responding operation at the time of stopping the operation of the system.

Still another object of the present invention is to provide an ultra low dropout voltage regulator, which has ultra low dropout characteristics so as to obtain a low output voltage even from an input voltage lower than a minimum input voltage $V_{IN,MIN}$ enabling the normal operation of the circuit.

In order to accomplish the above objects, the present invention provides an ultra low dropout voltage regulator for low voltage conversion, comprising a chip enable unit for controlling a bias voltage, supplied to drive internal circuits of a voltage regulator chip; a low reference voltage generation unit controlled by the chip enable unit and configured to set voltage and current to values within a predetermined range, or to generate the voltage and current; a pass element for receiving a voltage to be converted, passing only a stable voltage therethrough, and outputting the stable voltage; a feedback resistor for dividing the voltage output from the pass element, and feeding back a divided voltage to an error amplification stage; the error amplification stage controlled by the chip enable unit and configured to compare a reference voltage, output from the low reference voltage generation unit, and the voltage, fed back and output from the feedback resistor, and to amplify a difference between the output voltages, and smoothing an amplified signal; a gate drive stage controlled by the chip enable unit and configured to compare the output signal of the error amplification stage with the output voltage and to output a signal required to control the pass element in response to a control signal output from an overheat protection control logic; an overheat protection circuit controlled by the chip enable unit and configured to sense overload or overheat of the chip and to output a signal required to switch the output voltage; an overcurrent limiter controlled by the chip enable unit and configured to perform control to receive an input voltage and to output limited current through a logic interface; and the overheat protection control logic controlled by the chip enable unit and configured to receive the output signal of the overheat protection circuit and an output signal of the overcurrent limiter and to control the output signal of the gate drive stage.

Preferably, the chip enable unit may comprise a power supply node for controlling supply of a bias voltage required to drive internal circuits of the chip, and a disable node for supplying an overload control signal to the overheat protection control logic.

Preferably, the low reference voltage generation unit may comprise a bias unit for receiving the bias voltage from the chip enable unit and supplying the bias voltage through a current mirror; a first current generation unit connected to the bias unit through a current mirror and biased by the bias unit, the first current generation unit generating a first current proportional to a base-emitter voltage of a bipolar transistor; a first PMOS amplification unit for receiving an output voltage signal from the first current generation unit, and amplify and outputting the output voltage signal; a second current generation unit connected to the bias unit through a current mirror and biased by the bias unit, the second current generation unit generating a second current proportional to a thermal voltage; a second PMOS amplification unit for receiving an output voltage signal from the second current generation unit, and amplifying and outputting the output voltage signal; and a differential amplification unit connected to the bias unit through a current mirror and biased by the bias unit, the differential amplification unit receiving signals amplified by the first and second PMOS amplification units, respectively, and to output a uniform reference voltage against variation in temperature and power supply voltage.

Preferably, the first PMOS amplification unit may comprise a first PMOS transistor for receiving an output signal of the first current generation unit through a gate thereof and outputting an amplified signal to a drain thereof, and an active load connected to the drain of the first PMOS transistor and provided with a grounded gate.

Preferably, the second PMOS amplification unit may comprise a second PMOS transistor for receiving an output signal of the second current generation unit through a gate thereof and outputting an amplified signal to a drain thereof, and an active load connected to the drain of the second PMOS transistor and provided with a grounded gate.

Preferably, the differential amplification unit may comprise a differential amplification input stage including first and second NMOS transistors for receiving output signals of the first and second PMOS amplification units, respectively; a current source connected to a source of the differential amplification input stage, the current source including an NMOS transistor for receiving the bias voltage from the bias unit and generating constant current; an active load configured to be connected to a drain of the second NMOS transistor of the differential amplification input stage, the active load being connected to the bias unit through a current mirror and biased by the bias unit; and an output stage connected to the drain of the first NMOS transistor of the differential amplification input stage, the output stage being biased by the bias unit through a current mirror to output the reference voltage.

Preferably, the active load may be implemented using two PMOS transistors connected in cascode.

Preferably, the feedback resistor may be configured to be trimmable.

Preferably, the feedback resistor may be implemented using a trimming-free feedback resistor comprising a plurality of metal wires, arranged in regular patterns, and conductive metal wiring patterns, configured to activate the metal wires by connecting the metal wires to each other, thus enabling trimming to be omitted.

Preferably, the metal wires may be formed to be wired so that all resistance values within an output voltage range can be realized.

Preferably, the metal wiring patterns may comprise contacts formed in certain portions thereof to select and connect some of the metal wires to each other, depending on a required output voltage.

Preferably, the overheat protection circuit may comprise a current generation unit for receiving the bias voltage from the chip enable unit to generate certain current; an overheat sensing unit connected to the current generation unit and configured to receive the certain current, to sense variation in temperature, and to operate at a temperature above a specific temperature; and an output unit for outputting an overheat protection signal determined using both an output current, which is generated using a first current mirror formed through connection to the current generation unit, and a driving voltage, which is input from the bias circuit.

Preferably, the overheat protection circuit may comprise a current generation unit for receiving the bias voltage from the chip enable unit to generate certain current; an overheat sensing unit connected to the current generation unit and configured to receive the certain current, to sense variation in temperature, and to operate at a temperature above a specific temperature; an output unit for outputting an overheat protection signal determined using both an output current that is generated using a first current mirror formed through connection to the current generation unit, and a driving voltage that is input from the bias circuit; a trigger signal generation unit for receiving the overheat protection signal from the output unit, and outputting a trigger bias signal, required to control operation, as an output control signal while feeding the trigger bias signal back to the overheat sensing unit; and a current amplification unit for generating output current using a second current mirror formed through connection to the current generation unit, receiving the trigger bias signal, fed back from the trigger signal generation unit, and controlling and amplifying the output current.

Preferably, the overheat sensing unit may comprise a bias resistor for fixing a specific voltage on a basis of the certain current generated by the current generation unit; and an overheat sensing transistor, a base and an emitter of which are connected to both ends of the bias resistor, respectively, thus enabling the driving voltage, varying with variation in temperature, to be fixed at a voltage identical to a voltage at both ends of the bias resistor.

Preferably, the trigger signal generation unit may be implemented using a Schmitt trigger circuit.

Preferably, the trigger signal generation unit may be implemented using an inverter comprising a PMOS transistor and an NMOS transistor.

Preferably the trigger signal generation unit may further comprise an output control inverter enabling the output control signal to be determined.

BRIEF DESCRIPTION OF THE DRAWINGS

The above and other objects, features and advantages of the present invention will be more clearly understood from the following detailed description, taken in conjunction with the accompanying drawings, in which.

DESCRIPTION OF THE PREFERRED EMBODIMENTS

Hereinafter, embodiments of the present invention will be described in detail with reference to the attached drawings.

Figure 1:
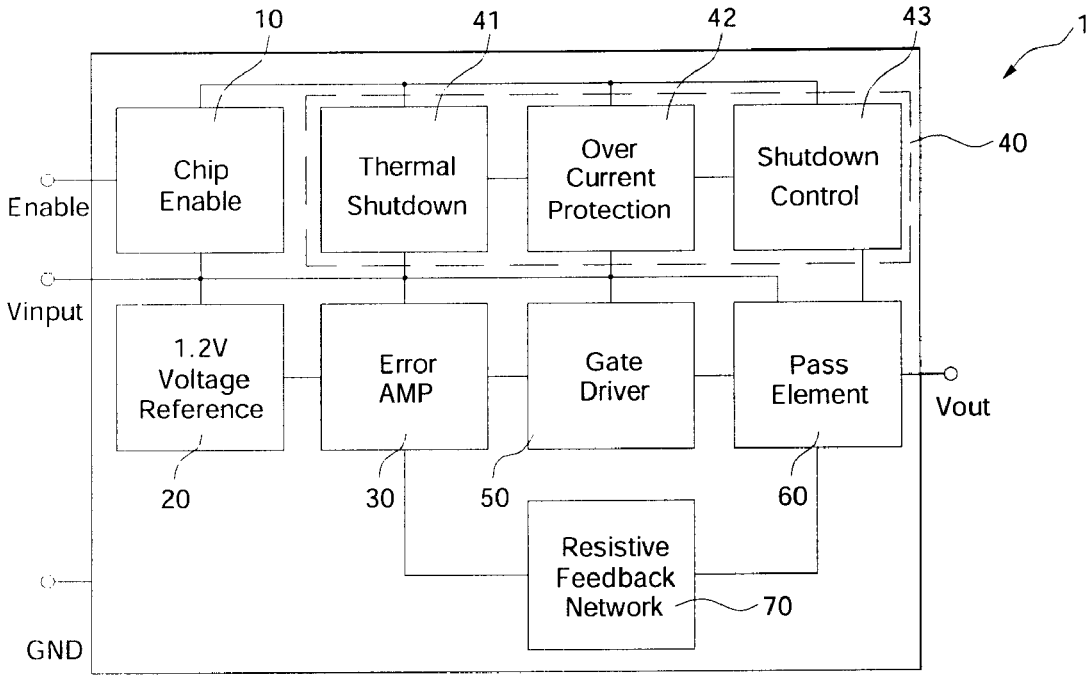
FIG. 1 (PRIOR ART)
FIG. 1 is a block diagram of a conventional low output voltage regulator.
Figure 2:
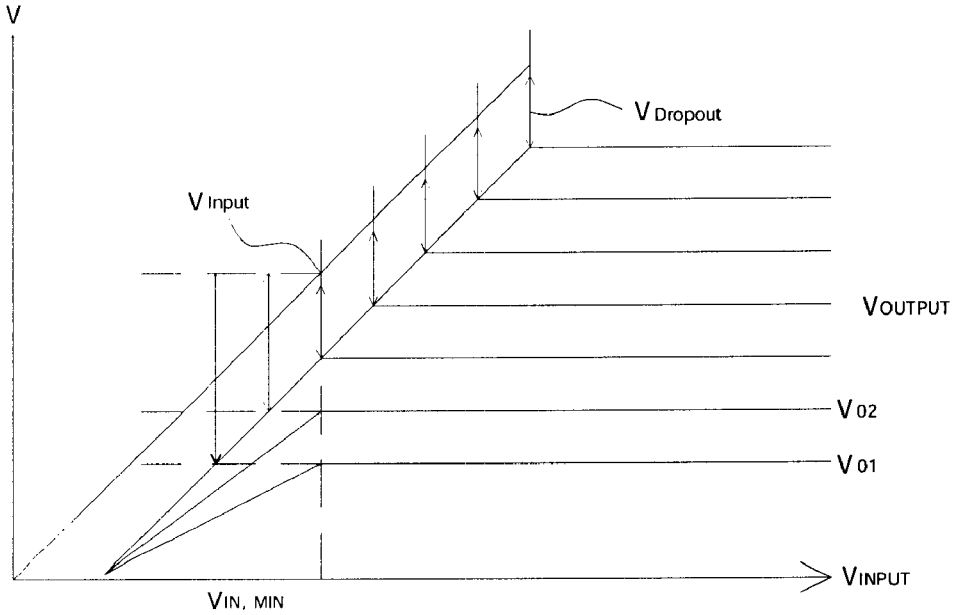
FIG. 2 (PRIOR ART)
FIG. 2 is a block diagram showing the ultra low dropout characteristics of the conventional low output voltage regulator.
Figure 3:
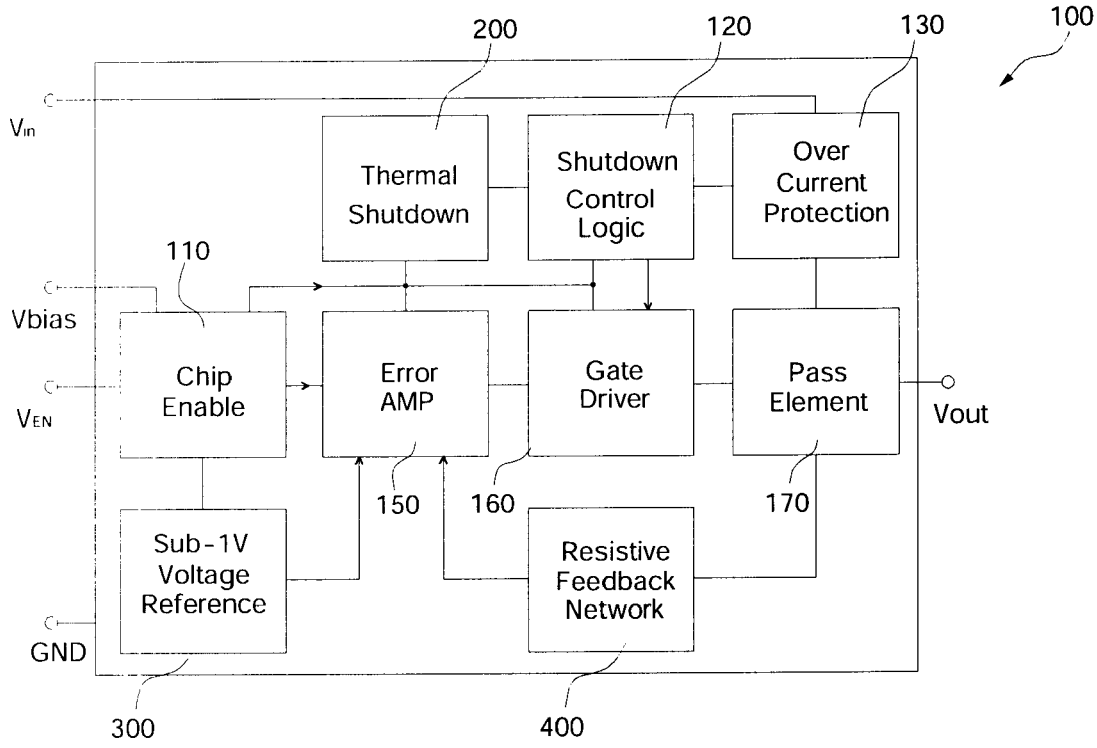
FIG. 3 is a schematic block diagram showing the construction of an ultra low dropout voltage regulator according to the present invention.

FIG. 3 is a schematic block diagram showing the construction of an ultra low dropout voltage regulator according to the present invention.

As shown in FIG. 3, an ultra low dropout voltage regulator 100 according to the present invention includes a chip enable unit 110, an overheat protection (thermal shutdown) circuit 200, an overheat protection (shutdown) control logic (shutdown control logic) 120, an overcurrent limiter (overcurrent protection unit) 130, a low reference voltage generation unit (sub-1V voltage reference) 300, a feedback resistor (resistive feedback network) 400, an error amplification stage 150, a gate drive stage 160, and a pass element 170.

Here, the chip enable unit 110, the overheat protection circuit 200, the low reference voltage generation unit 300, and the feedback resistor 400 are described in detail with reference to corresponding drawings.

The overcurrent limiter 130 is controlled by the chip enable unit 110 and performs a control operation to receive an input voltage $V_{in}$ to be converted and to output limited current through a logic interface composed of typical circuit components.

The overheat protection control logic 120 is controlled by the chip enable unit 110 and is configured to receive the output signal of the overheat protection circuit 200 and the output signal of the overcurrent limiter 130 and to transmit a signal to the gate drive stage 160 for controlling an output voltage.

The error amplification stage 150 is controlled by the chip enable unit 110, and is configured to compare the reference voltage $V_{ref}$, output from the low reference voltage generation unit 300, and the output voltage, fed back from the feedback resistor 400, amplifies the difference between respective output voltages, and smoothes the amplified output voltage.

The gate drive stage 160 is controlled by the chip enable unit 110, is also controlled in response to the control signal output from the overheat protection control logic 120, and is configured to receive the output signal of the error amplification stage 150 and to control the output of the input voltage $V_{in}$.

The pass element 170 is controlled so that it receives the voltage $V_{in}$ to be converted and passes only a stable voltage therethrough in response to the output signal of the gate drive stage, and thus outputs the voltage $V_{out}$.

Figure 4:
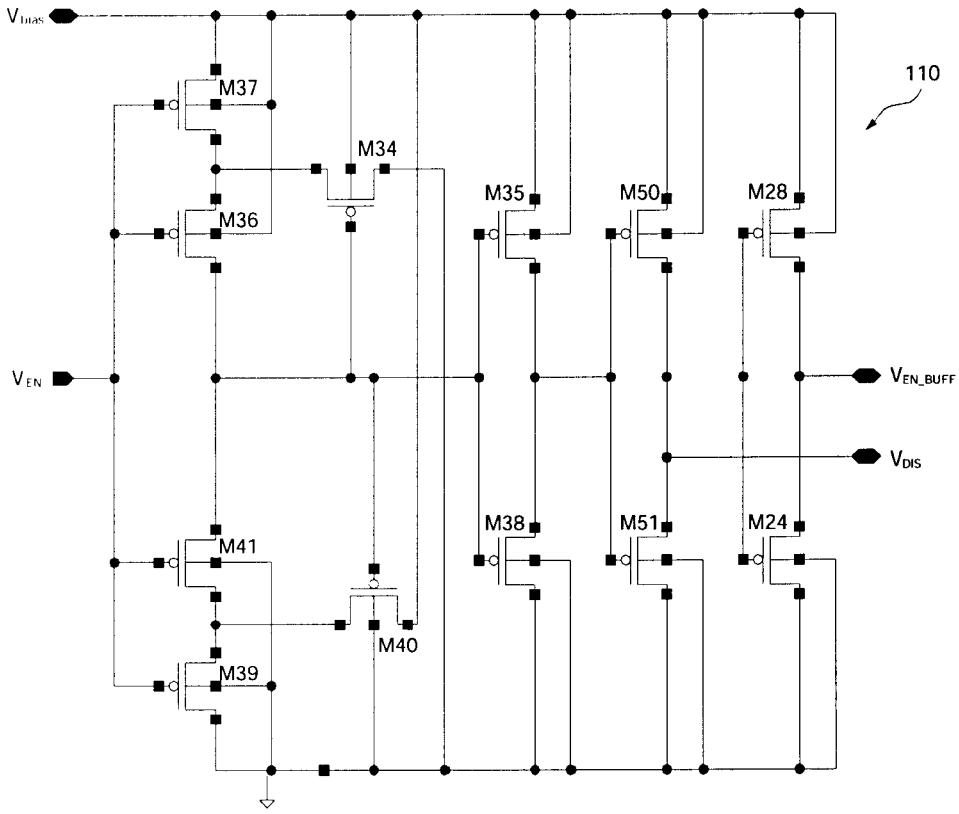
FIG. 4 is a circuit diagram showing an embodiment of a chip enable unit used in the ultra low dropout voltage regulator of the present invention to enable a chip and supply power.

FIG. 4 is a circuit diagram showing an embodiment of a chip enable unit used in the ultra low dropout voltage regulator of the present invention to enable a chip and supply power.

As shown in FIG. 4, the chip enable unit 110 includes a power supply node $V_{EN_BUFF}$ for controlling the supply of a bias voltage $V_{bias}$ required to drive the internal circuits of the voltage regulator chip, and a disable node $V_{DIS}$ for providing an overload control signal to the overheat protection control logic 120.

In detail, the power supply node $V_{EN_BUFF}$ enables the bias voltage $V_{bias}$ to pass therethrough as the power required to drive respective internal circuits, via a PMOS transistor M28, which receives the bias voltage $V_{bias}$ and functions as a pass transistor.

That is, the chip enable unit 110 causes a bias voltage $V_{bias}$ to be supplied in response to an enable signal $V_{EN_BUFF}$, which is required to drive the internal circuits and is identical to an input chip enable signal VEN. In other words, the chip enable unit 110 outputs the driving voltage $V_{EN_BUFF}$, which is a buffered signal.

However, the chip disable signal, input to the chip enable unit 110, entirely turns off the power required to operate the internal circuits through the PMOS transistor M28, functioning as the pass transistor. That is, the chip enable unit 110 causes the bias voltage $V_{bias}$, which is the driving voltage, to be shut off in response to a disable signal $V_{EN_BUFF}$, which is required to stop the driving of the internal circuits and is identical to the input chip disable signal.

This operating state is realized to greatly decrease the standby power of respective systems in standby states, for example, the state in which the LCD panel of a mobile phone is turned off after a predetermined period of time has elapsed, the state in which only the screen of an LCD monitor is turned off, or the state in which an MP3 player is operating, but only the screen thereof is turned off. Accordingly, the voltage regulator of the present invention is configured to shut off power to enable only a current of several nA to flow through the entire circuit, rather than realizing a simple logic-off state, in which a current of several mA to several tens of mA flows through the circuit.

Further, the disable node $V_{DIS}$ has an output signal opposite that of the power supply node $V_{EN_BUFF}$.

That is, the chip enable unit 110 outputs the signal opposite that of the power supply node $V_{EN_BUFF}$ to the overheat protection control logic 120 in response to the input chip enable signal or chip disable signal, thus causing the output signal to be used as a control signal.

In particular, in order to stop the driving of the internal circuits when overload or overheat occurs in the chip, the disable node $V_{DIS}$ is placed to precede the power supply node $V_{EN\text{-}_BUFF}$, and thus functions to more rapidly stop the driving of the internal circuits.

Figure 5:
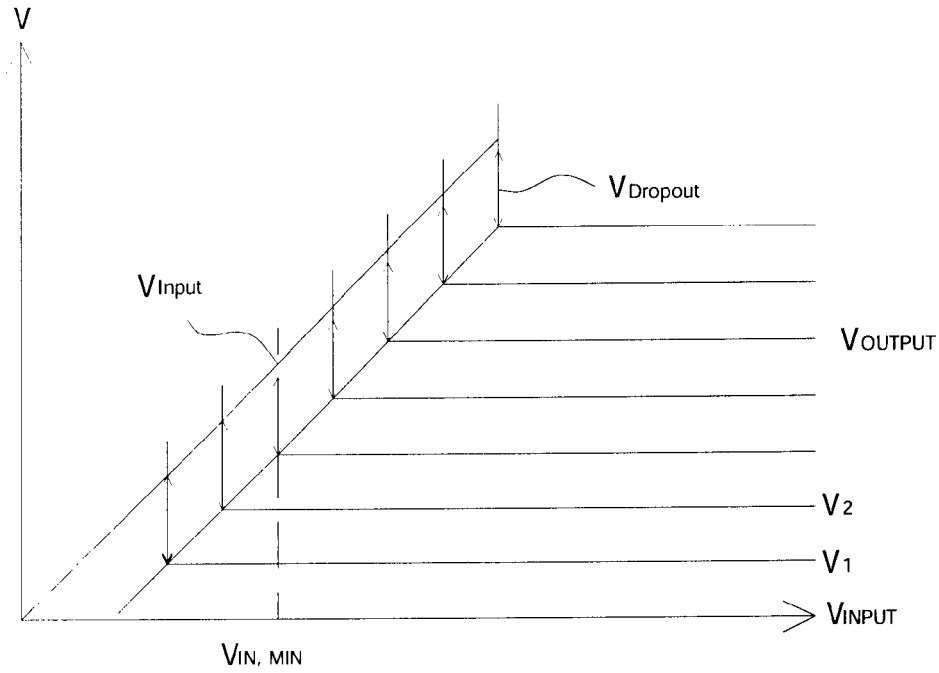
FIG. 5 is a diagram showing the ULDO of an ultra low dropout voltage regulator according to the present invention.

FIG. 5 is a diagram showing the ultra low dropout characteristics (ULDO) of an ultra low dropout voltage regulator according to the present invention.

As shown in FIG. 5, the ultra low dropout voltage regulator according to the present invention can obtain ULDO even in the case where an output voltage $V_{OUTPUT}$, which is output relative to an input voltage $V_{INPUT}$ lower than a minimum input voltage $V_{IN,MIN}$ enabling the normal operation of the circuit, is very low, as in the case of $V_1$ or $V_2$.

Such ULDO characteristics allow input/output power, which is to be converted and transmitted, to be separated by constructing the voltage regulator to separately supply power required for circuits. Therefore, regardless of the magnitude of the output voltage, ULDO characteristics are satisfied for all output voltages.

Figure 6:
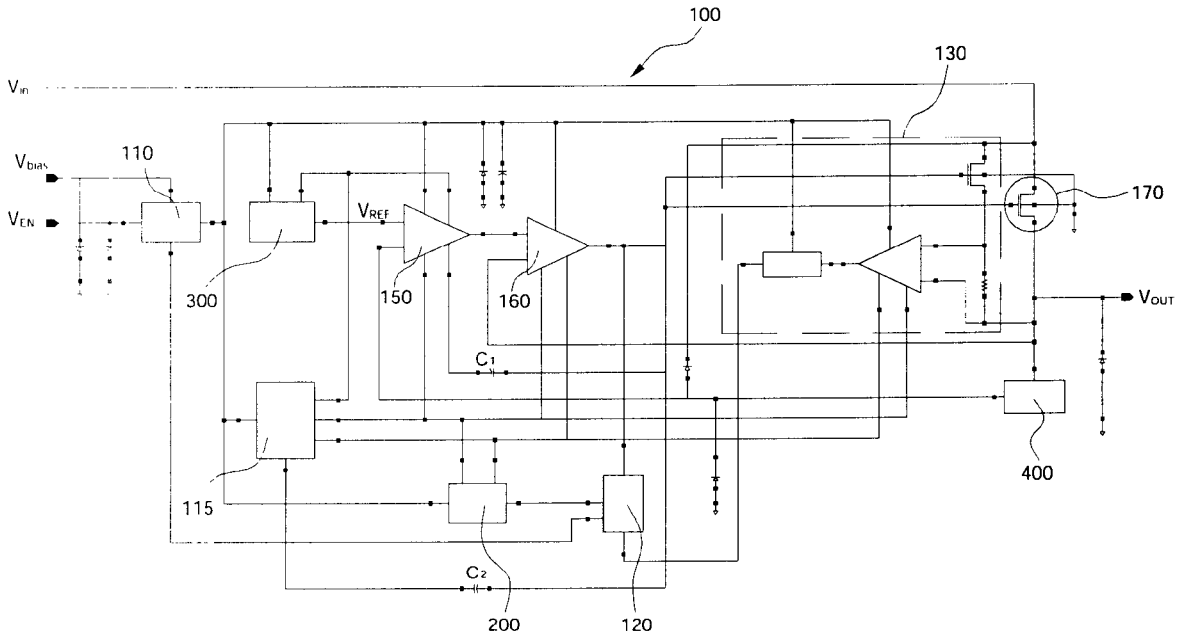
FIG. 6 is a circuit diagram showing an embodiment of an ultra low dropout voltage regulator according to the present invention.

FIG. 6 is a circuit diagram showing an embodiment of an ultra low dropout voltage regulator according to the present invention.

As shown in FIG. 6, an ultra low dropout voltage regulator 100 according to the present invention includes a chip enable unit 110, a bias generator 115, an overheat protection circuit 200, an overheat protection control logic 120, an overcurrent limiter 130, a low reference voltage generation unit 300, a feedback resistor 400, an error amplification stage 150, a gate drive stage 160, and a pass element 170.

The functions of respective components are described below.

First, an input voltage $V_{in}$ is connected to be separately and directly input to the pass element 170, and thus the pass element 170 is configured to output voltage under the control of the gate drive stage 160.

Further, a bias voltage $V_{bias}$, required to drive respective internal circuits of the ultra low dropout voltage regulator 100 according to the present invention, is configured to be input to the chip enable unit 110, and an enable signal or a disable signal required for the operation of the chip is also configured to be input to the chip enable unit 110.

The chip enable unit 110 is configured to provide both the control signal $V_{EN_BUFF}$ for the operation of the chip and the driving voltage $V_{bias}$ for the driving of respective circuits in the chip, to the bias generator 115, the overheat protection circuit 200, the overcurrent limiter 130, the low reference voltage generation unit 300, the error amplification stage 150, and the gate drive stage 160.

Further, the chip enable unit 110 is configured to output a chip disable signal $V_{DIS}$ to the overheat protection control logic 120.

The low reference voltage generation unit 300 outputs a reference voltage $V_{ref}$, thus allowing the reference voltage to be compared by the error amplification stage 150. The error amplification stage 150 compares the reference voltage $V_{ref}$, output from the low reference voltage generation unit 300, with the output voltage, fed back from the feedback resistor 400, amplifies the difference between the output voltages, and smoothes the amplified output signal. The gate drive stage 160 is configured to compare the output signal of the error amplification stage 150 with the output voltage $V_{out}$ of the ultra low dropout voltage regulator 100 of the present invention, and to output the signal required to control the pass element 170.

A preferred embodiment of the feedback resistor 400 is implemented in a circuit design to include metal wires arranged to function as a plurality of resistors, trimming pads and a plurality of fuses configured to electrically short the trimming pads, thus dividing the output voltage and feeding back the divided voltage to the error amplification stage 150. In this case, the trimming pads are preferably connected in parallel with respective resistors of the metal wires to activate selected resistors, thus adjusting a voltage division ratio. The fuses are preferably formed to electrically short neighboring trimming pads of the plurality of trimming pads.

Another embodiment of the feedback resistor 400 is implemented in a circuit design to include a plurality of metal wires, arranged in regular patterns, and conductive metal wiring patterns, configured to activate the metal wires by connecting the metal wires to each other, thus enabling a trimming process to be omitted. A detailed description thereof will be made later with reference to FIG. 8.

The overcurrent limiter 130 is controlled by the chip enable unit 110 and is configured to receive input voltage $V_{in}$ to be converted and to output limited current through a logic interface composed of typical circuit components. The overheat protection control logic 120 is controlled by the chip enable unit 110 and is configured to receive the output signal of the overheat protection circuit 200 and the output signal of the overcurrent limiter 130 and to output a signal to the gate drive stage 160 for controlling the output voltage $V_{out}$ of the ultra low dropout voltage regulator 100 according to the present invention, thus enabling the output voltage to be controlled.

The pass element 170 is controlled so that it receives the voltage $V_{in}$ to be converted and passes only stable voltage therethrough in response to the output signal of the gate drive stage 160.

Figure 7:
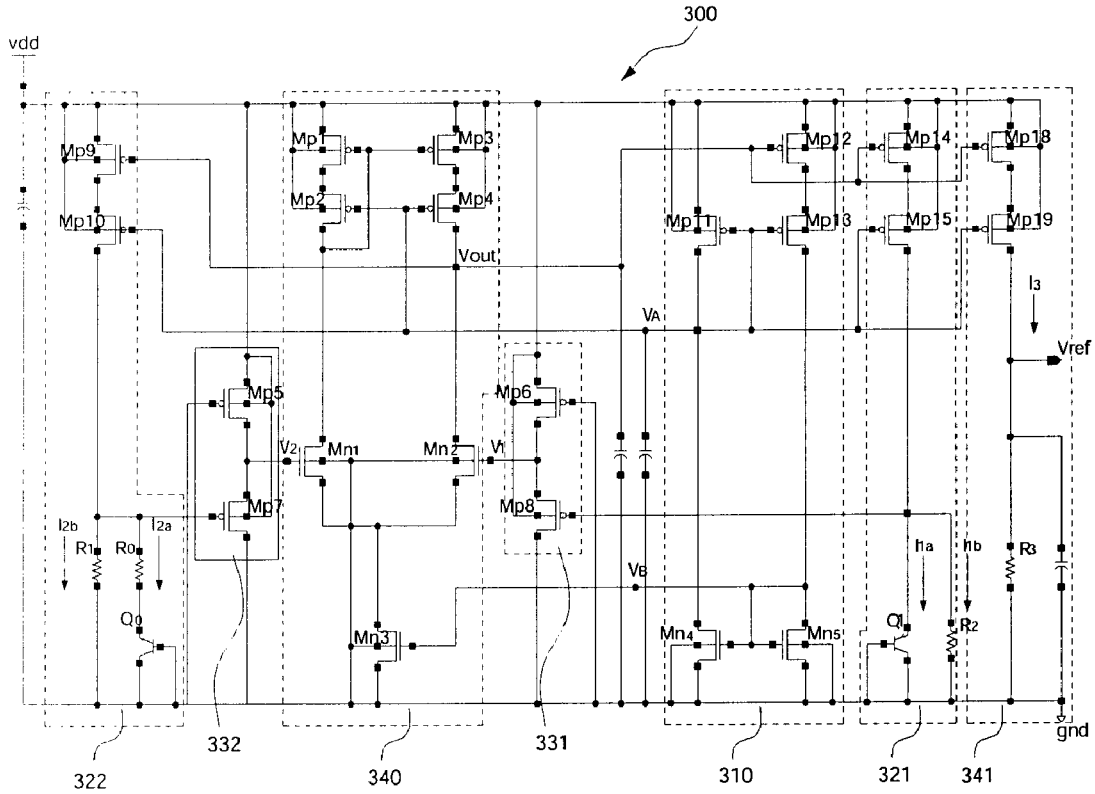
FIG. 7 is a circuit diagram showing an embodiment of a low voltage reference voltage generation unit used in the ultra low dropout voltage regulator according to the present invention.

FIG. 7 is a circuit diagram showing an embodiment of a low reference voltage generation unit used in an ultra low dropout voltage regulator according to the present invention As shown in FIG. 7, the low reference voltage generation unit 300 used in the ultra low dropout voltage regulator according to the present invention includes a bias unit 310, a first current generation unit 321, a first PMOS amplification unit 331, a second current generation unit 322, a second PMOS amplification unit 332, and a differential amplification unit 340.

The bias unit 310 includes a current mirror having PMOS transistors Mp11 and Mp13 and a current mirror having NMOS transistors Mn4 and Mn5.

In this case, the current mirror, composed of the PMOS transistors Mp11 and Mp13, biases the first current generation unit 321, the second current generation unit 322, and the output stage 341 of the differential amplification unit 340, and the current mirror, composed of the NMOS transistors Mn4 and Mn5, biases the current source Mn3 of the differential amplification unit 340.

The first current generation unit 321 includes a resistor $R_2$, a bipolar transistor $Q_1$, and a PMOS transistor Mp15, forming a current mirror together with the bias unit 310, and operates to receive voltage $V_A$ from the bias unit 310 through the gate of the PMOS transistor Mp15, and to generate current proportional to the base-emitter voltage of the bipolar transistor $Q_1$ at the resistor $R_2$ and the bipolar transistor $Q_1$.

The second current generation unit 322 includes a resistor $R_1$, a resistor $R_0$, and a transistor $Q_0$, and a PMOS transistor Mp10 forming a current mirror together with the bias unit 310, and operates to receive the voltage $V_A$ through the gate of the PMOS transistor Mp10 under the control of the bias unit 310 and to generate current proportional to the thermal voltage at the resistor $R_1$, the resistor $R_0$, and the transistor $Q_0$.

In the above description, operation related to the generation of current is similar to that of a conventional low reference voltage generator.

The first PMOS amplification unit 331 includes a PMOS transistor Mp8 and a PMOS transistor Mp6, the gate of which is grounded and which functions as an active load, and the second PMOS amplification unit 332 includes a PMOS transistor Mp7 and a PMOS transistor Mp5, the gate of which is grounded and which functions as an active load.

The differential amplification unit 340 includes a differential amplification input stage composed of NMOS transistors Mn1 and Mn2, a current source implemented using an NMOS transistor Mn3, which is connected to the source of the differential amplification input stage and is configured to receive bias voltage from the bias unit 310 and to generate constant current in order to drive the NMOS transistors Mn1 and Mn2 of the differential amplification input stage, an active load implemented using PMOS transistors Mp1 and Mp2, which are connected in cascode to the drain of the NMOS transistor Mn1 (hereinafter referred to as a 'second NMOS transistor') of the differential amplification input stage and are configured to receive the bias voltage from the bias unit 310, and the output stage 341, connected between the drain of the NMOS transistor Mn2 (hereinafter referred to as a 'first NMOS transistor') of the differential amplification input stage and the PMOS transistors Mp3 and Mp4 and configured to be biased by the bias unit 310 through the current mirror Mp19 and to output the reference voltage $V_{ref}$.

Since the voltage obtained from the currents generated by the first current generation unit 321 and the second current generation unit 322 is very low, the first and second NMOS transistors Mn1 and Mn2 of the differential amplification input stage cannot be driven. Therefore, in order to increase the gate voltages $V_1$ and $V_2$ required to drive the first and second NMOS transistors Mn1 and Mn2 of the differential amplification input stage, the first PMOS amplification unit 31 and the second PMOS amplification unit 332 are constructed using the PMOS transistors Mp7 and Mp8, which are driven in the case of a low input voltage.

Further, the PMOS transistors Mp1 and Mp2, connected to the drain of the second NMOS transistor Mn1 of the differential amplification input stage and functioning as an active load, are constructed to be connected in cascode.

This construction is required to solve the problem in which, in the implementation of an actual circuit, as power supply voltage increases, channel length modulation effects increase in an aspect ratio (W/L) the same as that of a short channel structure, which results in an increase in current, and thus current stability is decreased.

FIGS. 8A to 8E are diagrams showing embodiments of the feedback resistor used in the ultra low dropout voltage regulator according to the present invention, in detail, a feedback resistor needing no trimming (hereinafter referred to as a 'trimming-free feedback resistor').

As shown in FIGS. 8A to 8E, a trimming-free feedback resistor 400 used in the ultra low dropout voltage regulator according to the present invention includes a plurality of metal wires 402, arranged in regular patterns, and conductive metal wiring patterns 404, adapted to electrically activate the metal wires 402 by connecting the metal wires to each other, in a circuit implementation.

Figure 8A:
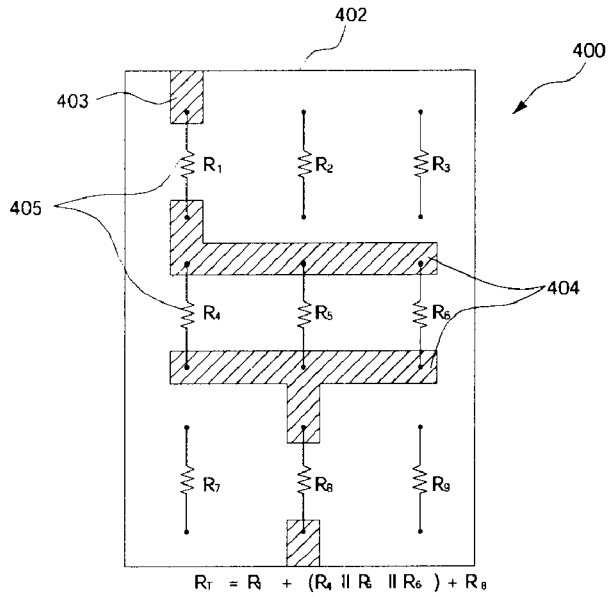
FIGS. 8A to 8E are diagrams showing embodiments of a feedback resistor used in the ultra low dropout voltage regulator according to the present invention, in detail, a trimming-free feedback resistor.
Figure 8B:
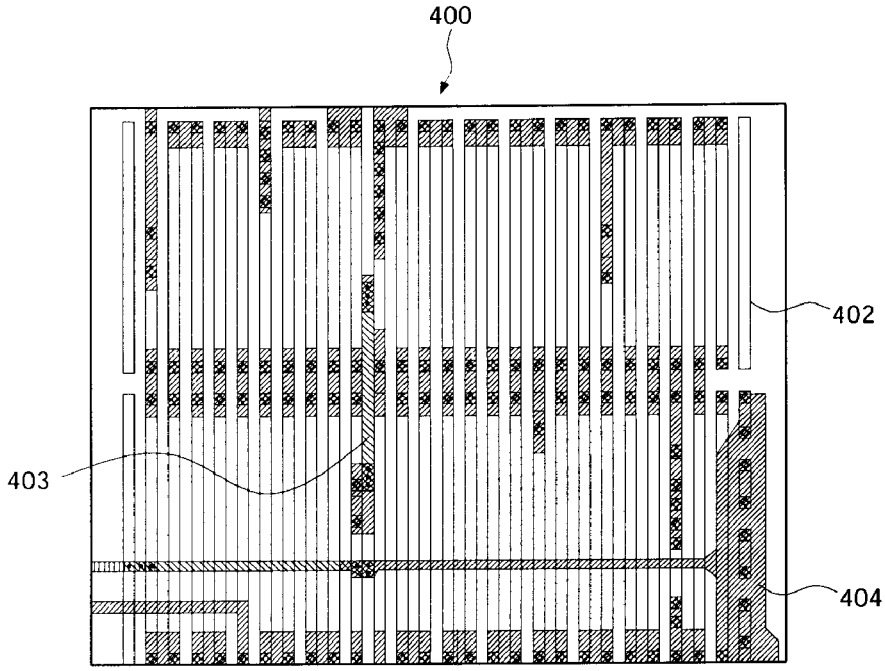
Figure 8C:
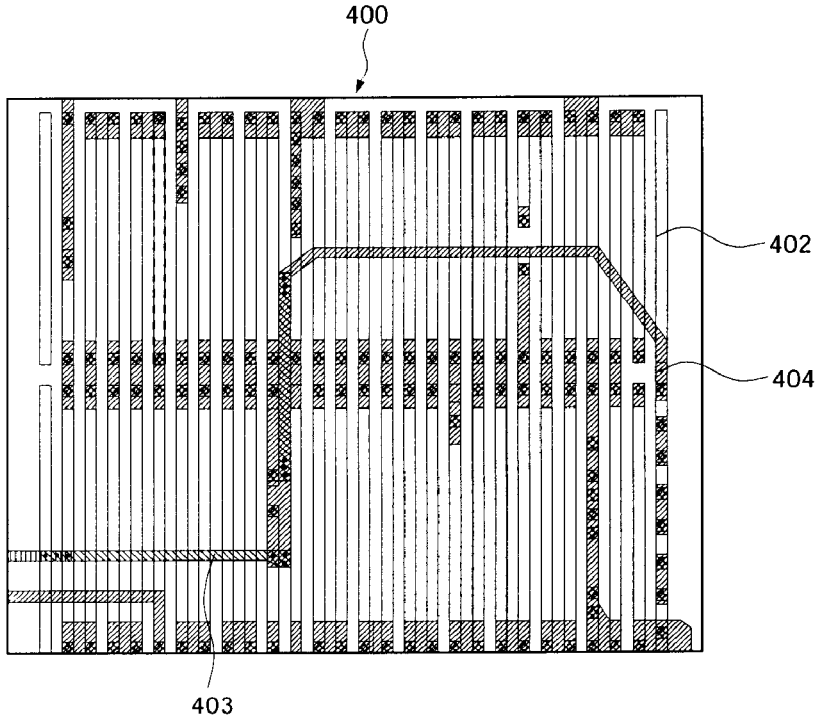
Figure 8D:
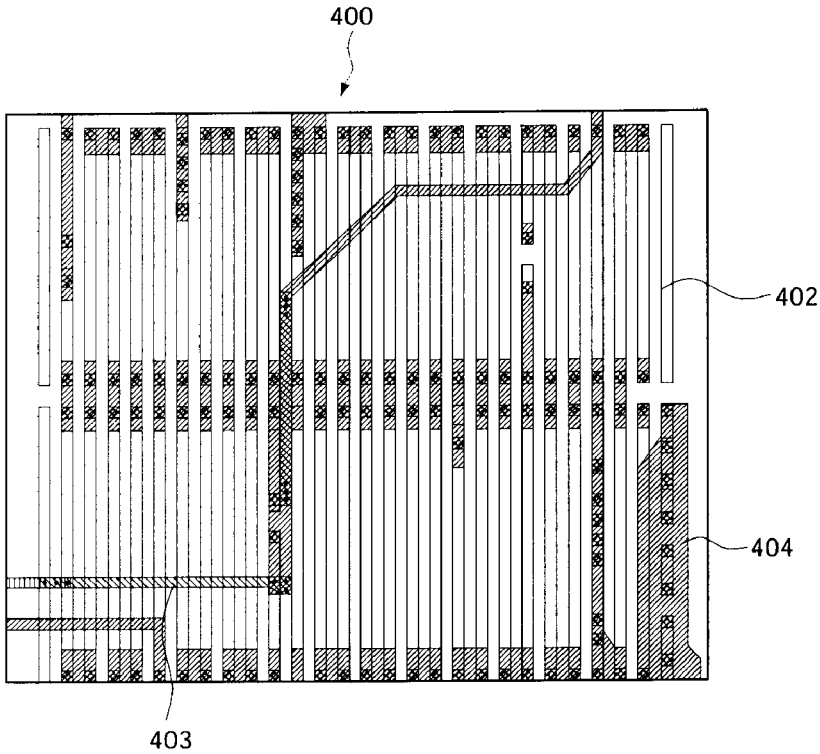
Figure 8E:
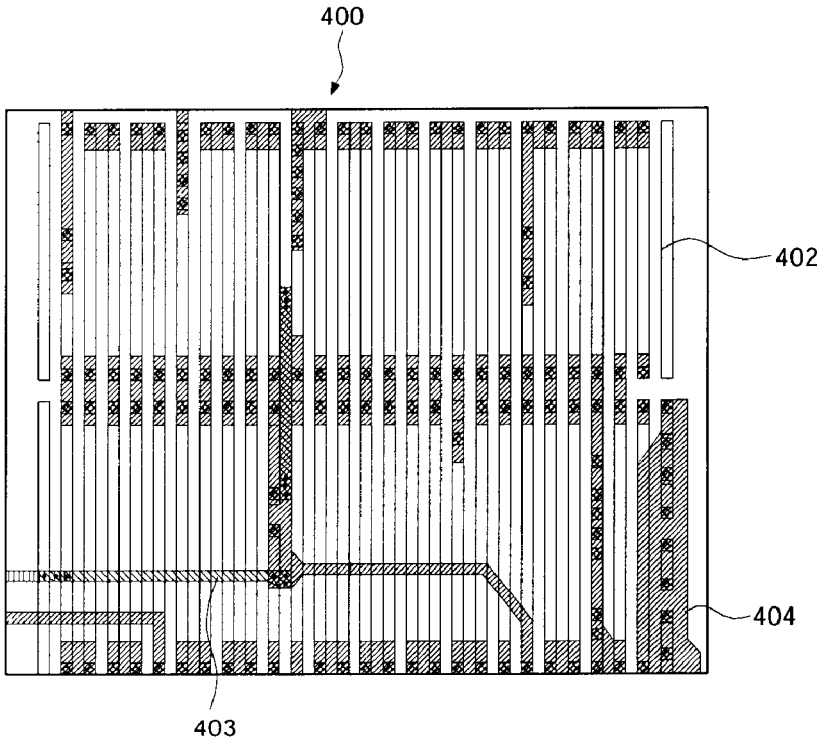

That is, FIG. 8A shows a simple example in which the feedback resistor 400 for dividing the output voltage and feeding back the divided voltage is implemented using a trimming-free feedback resistor 400 for which no trimming is required. In FIG. 8A, first to ninth resistors $R_1$ to $R_9$ are arranged as examples of components of the trimming-free feedback resistor 400.

The first to ninth resistors $R_1$ to $R_9$ can be configured such that some or all of them are activated, depending on the shapes of the metal wiring patterns 404.

Further, only a simple embodiment, in which only first to ninth resistors $R_1$ to $R_9$ are indicated, is shown, but it will be apparent that, in an actual device, more resistors can be used to realize all resistance values within the typical output voltage range (for example, 5V) of the voltage regulator.

In FIG. 8A, active resistors 405, which are activated among the resistors arranged as the metal wires 402, have a resistance value identical to the sum of the first resistor $R_1$, the fourth to sixth resistors $R_4$ to $R_6$, which are connected in parallel with each other, and the eighth resistor $R_8$, that is, $R_T=R_1+(R_4\|R_5\|R_6)+R_8$.

In this case, the metal wiring patterns 404 are formed to electrically connect the drain of the pass element 170 to the first resistor $R_1$, the first resistor $R_1$ to the fourth to sixth resistors $R_4$ to $R_6$, the fourth to sixth resistors $R_4$ to $R_6$ to the eighth resistor $R_8$, and the eighth resistor $R_8$ to a feedback resistor (not shown) connected to the ground.

FIGS. 8B to 8E illustrate embodiments of the feedback resistor 400 used in the ultra low dropout voltage regulator according to the present invention, which show embodiments in which metal wires 402 are selectively connected to each other using metal wiring patterns 404.

As shown in the drawings, the trimming-free feedback resistor 400 used in the ultra low dropout voltage regulator according to the present invention does not require a trimming process, and is determined through a plurality of metal wires 402 arranged in regular patterns, and the metal wiring patterns 404 adapted to select and connect metal wires 402 to each other to realize resistance suitable for the output voltage of the ultra low dropout voltage regulator 100.

Further, in the implementation of an actual circuit, the metal wires 402 and the pass element 170 are preferably connected to each other through contacts 403.

Figure 9:
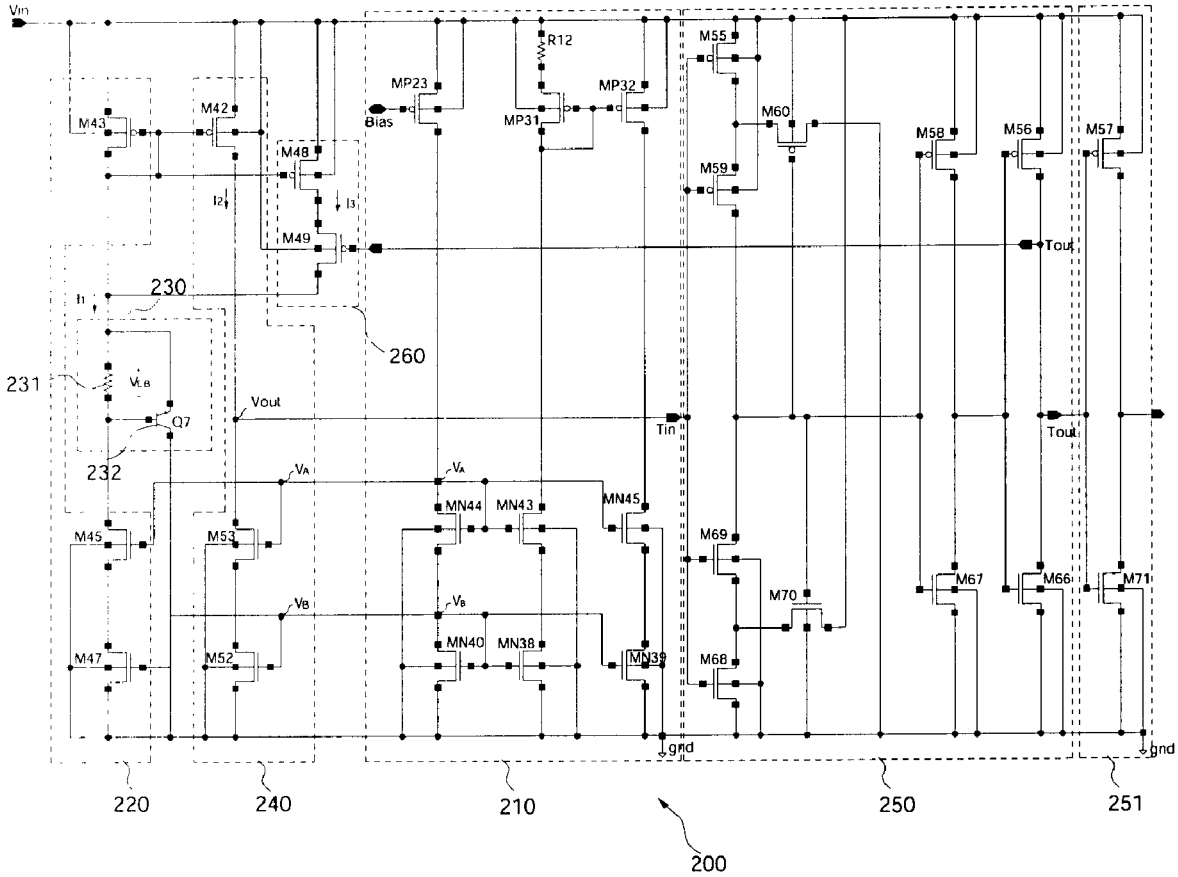
FIG. 9 is a circuit diagram showing an embodiment of an overheat protection circuit used in the ultra low dropout voltage regulator according to the present invention.

FIG. 9 is a circuit diagram showing an embodiment of an overheat protection circuit used for an ultra low dropout voltage regulator according to the present invention.

As shown in FIG. 9, the overheat protection circuit 200 used in the ultra low dropout voltage regulator 100 of the present invention includes a bias circuit 210, a current generation unit 220, an overheat sensing unit 230, an output unit 240, a trigger signal generation unit 250, a current amplification unit 260, and an output control inverter 251. Hereinafter, the operation between respective components constituting the overheat protection circuit is described in detail.

First, the bias circuit 210 receives a bias voltage through a PMOS transistor MP23 and supplies driving voltages $V_A$ and $V_B$ to respective NMOS transistors M45 and M47 of the current generation unit 220 and respective NMOS transistors M53 and M52 of the output unit 240.

Therefore, constant current $I_1$ is generated at the drain of a PMOS transistor M43 by the NMOS transistors M45 and M47 of the current generation unit 220, and thus a fixed voltage is induced at the bias resistor 231 of the overheat sensing unit 230. In this case, it will be apparent that the magnitude of the voltage to be fixed can be adjusted using the driving voltages $V_A$ and $V_B$ supplied by the bias circuit 210.

In a normal state, an overheat sensing transistor 232, the emitter and base of which are connected to both ends of the bias resistor 231 of the overheat sensing unit 230 to fix the driving voltage $V_{BE}$ thereof, is not operated. The output unit 240 outputs voltage $V_{out}$, which is induced at the drain of the NMOS transistor M53 and is determined by both the output current $I_2$, generated at the drain of the PMOS transistor M42, and the driving voltages $V_A$ and $V_B$, supplied by the bias circuit 210, that is, an output signal $V_{out}$, to the trigger signal generation unit 250 as an overheat protection signal having a low level, wherein the PMOS transistor M42 is connected to the PMOS transistor M43 of the current generation unit 220 to form a first current mirror.

The low-level overheat protection signal $V_{out}$ is converted into a high-level trigger bias signal $T_{out}$ by the trigger signal generation unit 250, which is implemented using a typical Schmitt trigger circuit composed of PMOS transistors M55, M56, M58, M59, and M60 and NMOS transistors M66, M67, M68, M69, and M70. The trigger bias signal $T_{out}$ is fed back to the PMOS transistor M49 of the current amplification unit 260, and is used to control, that is, shut down, the output current $I_3$ generated at the drain of the PMOS transistor M48, which is connected to the PMOS transistor M43 of the current generation unit 220 to form a second current mirror.

Further, the low-level overheat protection signal $V_{out}$ is input to the trigger signal generation unit 250, and a signal identical to the high-level trigger bias signal $T_{out}$ is output through the trigger signal generation unit 250 as an output control signal $T_{out}$. This output control signal $T_{out}$ enables the voltage regulator to be normally operated.

In this case, since the output control signal $T_{out}$ can vary depending on the type of power transistor used in the voltage regulator and the operation type of the overheat protection control logic, the overheat protection circuit further includes the output control inverter 251, implemented using a PMOS transistor M57 and an NMOS transistor M71, so as to determine the output control signal $T_{out}$, thus outputting the output control signal $T_{out}$.

Next, when temperature increases and overheat occurs, the overheat sensing transistor 232 of the overheat sensing unit 220, having a fixed driving voltage $V_{BE}$, is operated, thus enabling current $I_{CE}$ to flow therethrough. This shows that the current $I_1$ flowing through the drain of the PMOS transistor M43 is increased by the current $I_{CE}$.

The current $I_{CE}$ also increases the output current $I_2$ generated at the drain of the PMOS transistor M42 that is connected to the PMOS transistor M43 of the current generation unit 220 to form the first current mirror.

Further, since the driving voltages $V_A$ and $V_B$ are constant, the resistances of the NMOS transistors M52 and M53 of the output unit 240 are maintained at uniform values, which results in an increase in the voltage $V_{out}$ induced at the drain of the NMOS transistor M45 of the output unit 240 as the output current $I_2$, generated at the drain of the PMOS transistor M42 forming the first current mirror, increases, according to Ohm's law.

At this time, the output signal of the output unit 240 becomes a high-level voltage $V_{out}$, and is thus output to the trigger signal generation unit 250 as the overheat protection signal.

The high-level overheat protection signal $V_{out}$ is converted into a low-level trigger bias signal $T_{out}$ by the trigger signal generation unit 250, implemented using a typical Schmitt trigger circuit composed of the PMOS transistors M55, M56, M58, M59, and M60 and the NMOS transistors M66, M67, M68, M69, and M70, and is fed back to the PMOS transistor M49 of the current amplification unit 260. The fed-back trigger bias signal $T_{out}$ is operated to control the output current $I_3$, generated at the drain of the PMOS transistor M48 that is connected to the PMOS transistor M43 of the current generation unit 220 to form the second current mirror, thus enabling the output current to flow therethrough.

The output current $I_3$, generated at the drain of the PMOS transistor M48, is added to the current $I_1$ flowing through the overheat sensing unit 230, and the added current is input to the overheat sensing unit 230. Accordingly, a large amount of current flows into the overheat sensing unit 230, thus enabling the overheat sensing transistor 232 to be more rapidly and accurately operated at the time of shutting down the voltage regulator.

Further, the high-level overheat protection signal $V_{out}$ is input to the trigger signal generation unit 250, and a signal identical to the low-level trigger bias signal $T_{out}$ is output through the trigger signal generation unit 250 as an output control signal $T_{out}$. The output control signal $T_{out}$ enables the voltage regulator to be shut down, thus preventing the voltage regulator from overheating.

Since the output control signal $T_{out}$ varies according to the type of power transistor used in the voltage regulator and the operation type of the overheat protection control logic, it is output through the output control inverter 251 composed of the PMOS transistor M57 and the NMOS transistor M71, which are required to determine the output control signal $T_{out}$.

As described above, the ultra low dropout voltage regulator of the present invention having the above construction is advantageous in that driving voltage required for internal circuits and input voltage for conversion are input separately, and are operated, thus minimizing the consumption of standby power when the chip is disabled.

Further, the present invention is advantageous in that a reference voltage generation unit having low output voltage can be implemented, without needing to implement the transistor of the input stage of a differential amplifier, used in a reference voltage generation unit, in the form of a MOS transistor operating at a low voltage, through a separate process, and without requiring a deep sub-micron process, thus decreasing manufacturing costs.

Further, the present invention is advantageous in that a voltage division unit, having a resistor structure implemented using trimming pads, can be implemented without using trimming pads, thus reducing the size of a voltage regulator chip, and reducing the manufacturing costs thereof.

Further, the present invention is advantageous in that a simplified overheat sensing circuit is constructed to sense the overheat temperature of the voltage regulator chip, thus reducing costs while guaranteeing the reliability and stability of a rapid responding operation at the time of stopping the operation of the system when overload or overheat occurs.

In addition, the present invention is advantageous in that the ultra low dropout characteristics (ULDO) can be realized to obtain low output voltage even from input voltage lower minimum input voltage $V_{IN,MIN}$ enabling the normal operation of the circuit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ultra low dropout voltage regulator for low voltage conversion, comprising:

a chip enable unit for controlling a bias voltage, supplied to drive internal circuits of a voltage regulator chip;

a low reference voltage generation unit controlled by the chip enable unit and configured to set voltage and current to values within a predetermined range, or to generate the voltage and current;

a pass element for receiving a voltage to be converted, passing only a stable voltage therethrough, and outputting the stable voltage;

a feedback resistor for dividing the voltage output from the pass element, and feeding back a divided voltage to an error amplification stage;

the error amplification stage controlled by the chip enable unit and configured to compare a reference voltage, output from the low reference voltage generation unit, and the voltage, fed back and output from the feedback resistor, and to amplify a difference between the output voltages, and smoothing an amplified signal;

a gate drive stage controlled by the chip enable unit and configured to compare the output signal of the error amplification stage with the output voltage and to output a signal required to control the pass element in response to a control signal output from an overheat protection control logic;

an overheat protection circuit controlled by the chip enable unit and configured to sense overload or overheat of the chip and to output a signal required to switch the output voltage;

an overcurrent limiter controlled by the chip enable unit and configured to perform control to receive an input voltage and to output limited current through a logic interface; and the overheat protection control logic controlled by the chip enable unit and configured to receive the output signal of the overheat protection circuit and an output signal of the overcurrent limiter and to control the output signal of the gate drive stage.

2. The ultra low dropout voltage regulator according to claim 1, wherein the chip enable unit comprises a power supply node for controlling supply of a bias voltage required to drive internal circuits of the chip, and a disable node for supplying an overload control signal to the overheat protection control logic.

3. The ultra low dropout voltage regulator according to claim 1, wherein the low reference voltage generation unit comprises:

a bias unit for receiving the bias voltage from the chip enable unit and supplying the bias voltage through a current mirror;

a first current generation unit connected to the bias unit through a current mirror and biased by the bias unit, the first current generation unit generating a first current proportional to a base-emitter voltage of a bipolar transistor;

a first PMOS amplification unit for receiving an output voltage signal from the first current generation unit, and amplifying and outputting the output voltage signal;

a second current generation unit connected to the bias unit through a current mirror and biased by the bias unit, the second current generation unit generating a second current proportional to a thermal voltage;

a second PMOS amplification unit for receiving an output voltage signal from the second current generation unit, and amplifying and outputting the output voltage signal; and a differential amplification unit connected to the bias unit through a current mirror and biased by the bias unit, the differential amplification unit receiving signals amplified by the first and second PMOS amplification units, respectively, and to output a uniform reference voltage against variation in temperature and power supply voltage.

4. The ultra low dropout voltage regulator according to claim 3, wherein the first PMOS amplification unit comprises a first PMOS transistor for receiving an output signal of the first current generation unit through a gate thereof and outputting an amplified signal to a drain thereof, and an active load connected to the drain of the first PMOS transistor and provided with a grounded gate.

5. The ultra low dropout voltage regulator according to claim 3, wherein the second PMOS amplification unit comprises a second PMOS transistor for receiving an output signal of the second current generation unit through a gate thereof and outputting an amplified signal to a drain thereof and an active load connected to the drain of the second PMOS transistor and provided with a grounded gate.

6. The ultra low dropout voltage regulator according to claim 3, wherein the differential amplification unit comprises:

a differential amplification input stage including first and second NMOS transistors for receiving output signals of the first and second PMOS amplification units, respectively;

a current source connected to a source of the differential amplification input stage, the current source including an NMOS transistor for receiving the bias voltage from the bias unit and generating constant current;

an active load configured to be connected to a drain of the second NMOS transistor of the differential amplification input stage, the active load being connected to the bias unit through a current mirror and biased by the bias unit; and an output stage connected to the drain of the first NMOS transistor of the differential amplification input stage, the output stage being biased by the bias unit through a current mirror to output the reference voltage.

7. The ultra low dropout voltage regulator according to claim 6, wherein the active load is implemented using two PMOS transistors connected in cascode.

8. The ultra low dropout voltage regulator according to claim 1, wherein the feedback resistor is configured to be trimmable.

9. The ultra low dropout voltage regulator according to claim 1, wherein the feedback resistor is implemented using a trimming-free feedback resistor comprising a plurality of metal wires, arranged in regular patterns, and conductive metal wiring patterns, configured to activate the metal wires by connecting the metal wires to each other, thus enabling trimming to be omitted.

10. The ultra low dropout voltage regulator according to claim 9, wherein the metal wires are formed to be wired so that all resistance values within an output voltage range can be realized.

11. The ultra low dropout voltage regulator according to claim 9, wherein the metal wiring patterns comprise contacts formed in certain portions thereof to select and connect some of the metal wires to each other, depending on a required output voltage.

12. The ultra low dropout voltage regulator according to claim 1, wherein the overheat protection circuit comprises:

a current generation unit for receiving the bias voltage from the chip enable unit to generate certain current;

an overheat sensing unit connected to the current generation unit and configured to receive the certain current, to sense variation in temperature, and to operate at a temperature above a specific temperature; and an output unit for outputting an overheat protection signal determined using both an output current, which is generated using a first current mirror formed through connection to the current generation unit, and a driving voltage, which is input from the bias circuit.

13. The ultra low dropout voltage regulator according to claim 1, wherein the overheat protection circuit comprises:

a current generation unit for receiving the bias voltage from the chip enable unit to generate certain current;

an overheat sensing unit connected to the current generation unit and configured to receive the certain current, to sense variation in temperature, and to operate at a temperature above a specific temperature;

an output unit for outputting an overheat protection signal determined using both an output current that is generated using a first current mirror formed through connection to the current generation unit, and a driving voltage that is input from the bias circuit;

a trigger signal generation unit for receiving the overheat protection signal from the output unit, and outputting a trigger bias signal, required to control operation, as an output control signal while feeding the trigger bias signal back to the overheat sensing unit; and a current amplification unit for generating output current using a second current mirror formed through connection to the current generation unit, receiving the trigger bias signal, fed back from the trigger signal generation unit, and controlling and amplifying the output current.

14. The ultra low dropout voltage regulator according to claim 12, wherein the overheat sensing unit comprises:

a bias resistor for fixing a specific voltage on a basis of the certain current generated by the current generation unit; and an overheat sensing transistor, a base and an emitter of which are connected to both ends of the bias resistor, respectively, thus enabling the driving voltage, varying with variation in temperature, to be fixed at a voltage identical to a voltage at both ends of the bias resistor.

15. The ultra low dropout voltage regulator according to claim 13, wherein the overheat sensing unit comprises:

a bias resistor for fixing a specific voltage on a basis of the certain current generated by the current generation unit; and an overheat sensing transistor, a base and an emitter of which are connected to both ends of the bias resistor, respectively, thus enabling the driving voltage, varying with variation in temperature, to be fixed at a voltage identical to a voltage at both ends of the bias resistor.

16. The ultra low dropout voltage regulator according to claim 13, wherein the trigger signal generation unit is implemented using a Schmitt trigger circuit.

17. The ultra low dropout voltage regulator according to claim 13, wherein the trigger signal generation unit is implemented using an inverter comprising a PMOS transistor and an NMOS transistor.

18. The ultra low dropout voltage regulator according to claim 13, wherein the trigger signal generation unit further comprises an output control inverter enabling the output control signal to be determined.

* * * * *